US006986594B2

(12) United States Patent
Wirth et al.

(10) Patent No.: US 6,986,594 B2
(45) Date of Patent: Jan. 17, 2006

(54) LIGHTING DEVICE FOR MOTOR VEHICLES

(75) Inventors: Hans Joachim Wirth, Oberstenfeld (DE); Matthias Purz, Freiberg (DE); Katrin Burgemeister, Ostfildern (DE)

(73) Assignee: Valeo Wischersystem GmbH, Beitigheim-Bissingen (DE)

( * ) Notice: Subject to any disclaimer, the term of this patent is extended or adjusted under 35 U.S.C. 154(b) by 0 days.

(21) Appl. No.: 10/414,329

(22) Filed: Apr. 15, 2003

(65) Prior Publication Data

US 2003/0218882 A1 Nov. 27, 2003

(30) Foreign Application Priority Data

Apr. 18, 2002 (DE) ..... 102 19 246

(51) Int. Cl.
*F21V 5/00* (2006.01)

(52) U.S. Cl. ..... 362/328; 362/305; 362/308; 362/335

(58) Field of Classification Search ..... 362/297, 362/298, 299, 304, 305, 308, 327, 328, 329, 362/335, 337, 345, 346
See application file for complete search history.

(56) References Cited

U.S. PATENT DOCUMENTS

| | | | | | |
|---|---|---|---|---|---|
| 2,981,827 | A | * | 4/1961 | Orsatti et al. | 362/328 |
| 4,755,916 | A | * | 7/1988 | Collins | 362/298 |
| 5,582,480 | A | * | 12/1996 | Zwick et al. | 362/329 |
| 6,558,032 | B2 | * | 5/2003 | Kondo et al. | 362/346 |

FOREIGN PATENT DOCUMENTS

| | | |
|---|---|---|
| EP | 0230 834 | 8/1987 |
| EP | 0354 961 | 2/1990 |
| EP | 0 942 225 | 9/1999 |
| EP | 1 179 706 | 5/2003 |
| EP | 1 355 108 | 10/2003 |

* cited by examiner

*Primary Examiner*—Y. My Quach-Lee
(74) *Attorney, Agent, or Firm*—Morgan & Finnegan, LLP

(57) ABSTRACT

A lighting device for motor vehicles comprises a light source and an end cover having at least a first section and a second section. The lighting device further comprises a first reflector, which directs light emitted by the light source on to the end cover. A first optically active element is arranged in the ray path between the light source and the first reflector and deflects the light rays emitted by the light source, so that the deflected rays strike the first reflector at an angle of incidence, the associated angle of reflection of which causes the rays from the first reflector to be directed at least substantially on to the second section of the end cover.

16 Claims, 2 Drawing Sheets

LIGHTING DEVICE FOR MOTOR VEHICLES

Figure 1:
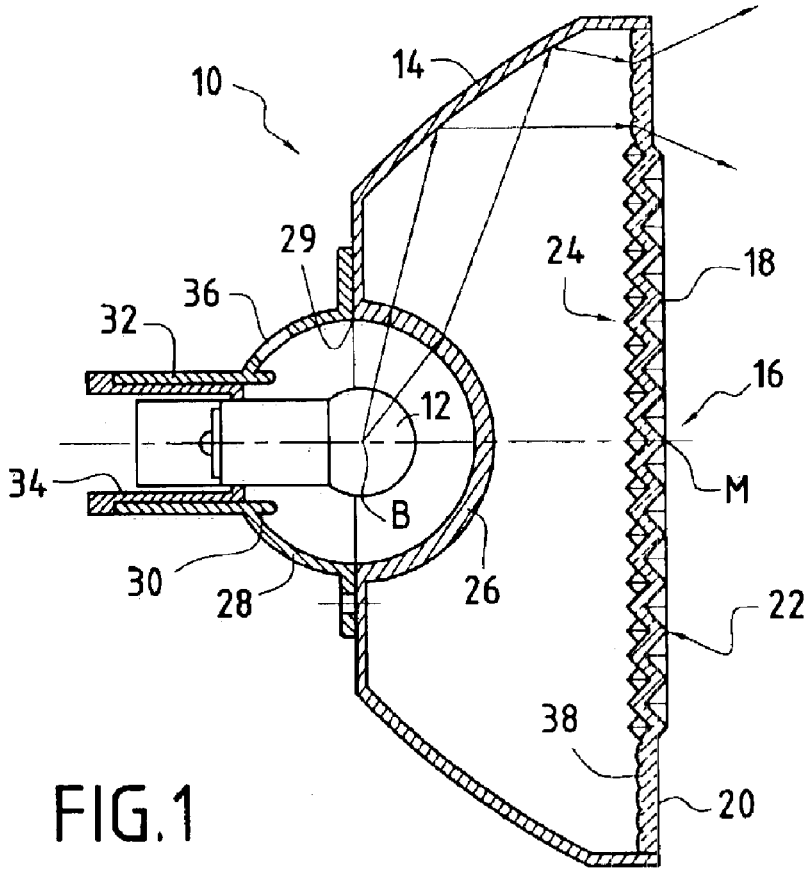

The present invention relates to a lighting device for motor vehicles and in particular to a lighting device that can be used as a motor vehicle lamp.

Motor vehicle lamps essentially serve to render the outlines of the vehicle visible even in the dark and to indicate the manoeuvring intentions of the vehicle driver to other road users. Such lamps may be side lamps and parking lamps, rear lamps, turn-signal indicators or brake lights and usually comprise a light source together with an end cover composed of a suitable material such as glass or plastic, for example. In modern motor vehicles, however, use is increasingly being made of lamps which have an end cover comprising multiple sections. The various sections of the end cover can then have different optical characteristics, colours and design shapes.

In such lamps having an end cover comprising multiple sections it may be desirable, not only on aesthetic but also on functional grounds, for example, to concentrate the light from the light source on to specific sections of the end cover instead of shining it uniformly on to the end cover.

The object of the present invention, therefore, is to provide a lighting device for motor vehicles having an end cover made up of multiple sections, in which such a concentration of the light beams emitted from the light source on to specific sections of the end cover is possible.

According to the invention this object is achieved by a lighting device which comprises a light source and an end cover having at least a first section and a second section. The light source may be an R5W bulb, for example, or some other bulb or another means of illumination, such as LED's for example. The lighting device further comprises a first reflector, which directs light emitted by the light source on to the end cover. A first optically active element, which deflects the light rays emitted by the light source so that the deflected rays strike the first reflector at an angle of incidence, the associated angle of reflection of which causes the rays from the first reflector to be directed at least substantially on to the second section of the end cover, is arranged in the ray path between the light source and the reflector. In other words, the first optically active element deflects the light rays in such a way that the rays only strike those areas of the first reflector which transmit the light on to the second section of the end cover. The arrangement according to the invention therefore allows the light emitted by the light source to be concentrated on to a defined section of the end cover.

The first section of the end cover preferably has a lower light transmission than the second section of the end cover. Here the first section may either still have a certain light transmission or it may be completely non-transparent. The arrangement according to the invention means that in such a lighting device the light losses due to the emission of light on to the less transparent first section of the end cover are minimised, thereby permitting optimum utilisation of the light emitted by the light source.

The first section of the end cover may be arranged in a central area of the end cover and enclosed by the second section of the end cover. The first section is preferably circular and the second section of annular design shape. The first optically active element then directs the light rays emitted by the light source at an angle of incidence to the first reflector, the associated angle of reflection of which causes the rays from the first reflector to be directed on to the annular second section of the end cover enclosing the first section. In this way a circular lamp can be provided which creates an especially attractive aesthetic impression.

The first section of the end cover is preferably designed as reflex reflector and reflects light incident upon its outer surface remote from the light source. The reflex reflector is only slightly transparent, if at all, for light shone by the light source on to its inner surface facing the light source. A lighting device of such a type is particularly suited to use as a vehicle tail light, for example as a rear lamp or brake light. The concentration of the light rays emitted by the light source on to the second section of the end cover means that a high luminous efficiency can be achieved despite the low light transmission of the reflex reflector.

The light source is advantageously arranged behind the first section of the end cover designed as reflex reflector. This makes it impossible to discern the light source, for example a bulb, from outside, thereby creating an especially attractive aesthetic impression.

The light source may be a bulb, the filament of which is arranged at the focal point of the first reflector.

The first optically active element is preferably hemispherical. This ensures that all the light emitted by the light source passes through the first optically active element. The centre of the hemispherical first optically active element preferably coincides with the focal point of the first reflector.

The first optically active element may be provided with an annular prism and cylindrical lens. The prism lens produces a deflection or a total reflection of the incident light rays, whilst the cylindrical lens causes a dispersion. The first optically active element furthermore contains non-optical surfaces. The term "non-optical surfaces" is here used to refer to surfaces having no optical function, through which the light is directed straight on to the first reflector without being deflected or reflected.

In a preferred embodiment of the lighting device according to the invention a second reflector, which reflects light not shone directly from the light source on to the first optically active element on to the first optically active element, is provided adjacent to the first reflector. The second reflector may be hemispherical and may enclose the light source on a side remote from the end cover. The light source may extend into the second reflector through an aperture, a cylindrical continuation of the second reflector surrounding a socket holder for the light source. The second reflector also permits the utilisation of light that has not been shone directly on to the first optically active element, thereby further increasing the luminous efficiency of the lighting device.

The second reflector is preferably provided with at least one ventilation opening in order to prevent heat accumulation inside the light device.

In a first preferred embodiment of the lighting device according to the invention the first reflector is a parabolic reflector, so that the light rays directed on to the first reflector by the first optical element are directed essentially parallel to one another on to the second section of the end cover. Alternatively the first reflector may also, however, be designed as free-form reflector.

The second section of the end cover may be of light-dispersing design, the dispersion of the light directed on to the second section of the end cover being produced by a plurality of lenses. This ensures a uniform distribution of the light emitted by the lighting device.

Alternatively, in a second preferred embodiment of the lighting device according to the invention the first reflector may also be provided with a plurality of second optically active elements, which disperse light rays incident upon the first reflector so that they are directed as diffused radiation on to the second section of the end cover. In this embodiment of the lighting device the light directed on to the first reflector by the first optically active element is already dispersed by the second optically active elements, so that a uniform light distribution is obtained. A dispersion lens formed in the second section of the end cover is therefore not required in this embodiment.

Figure 2:
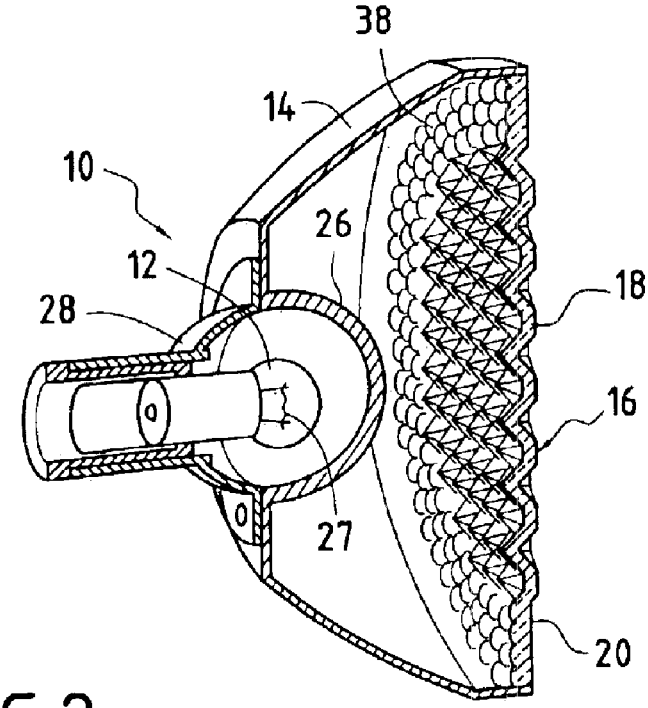
Figure 3:
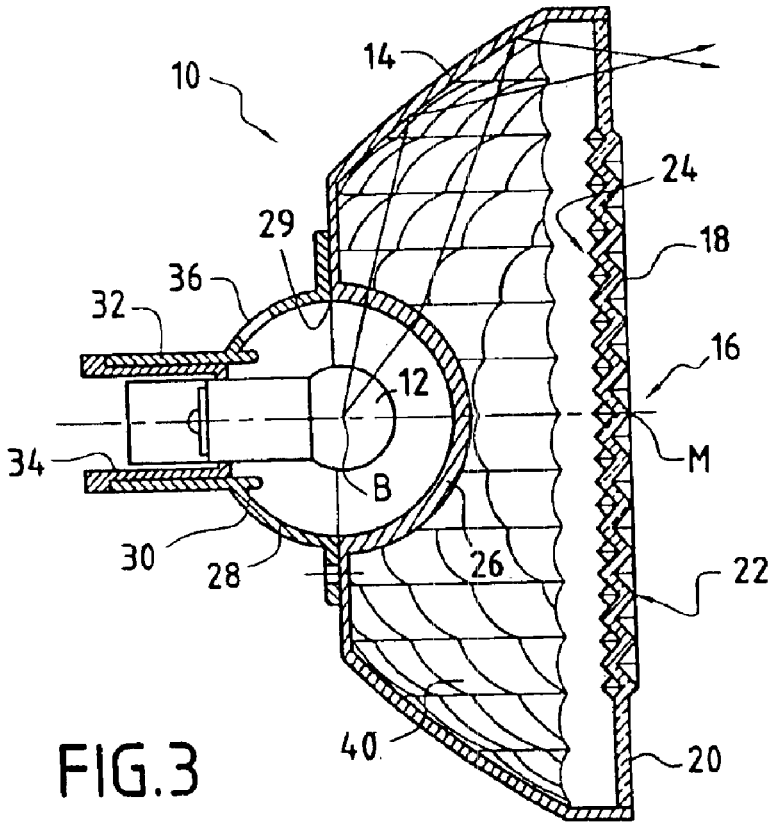
Figure 4:
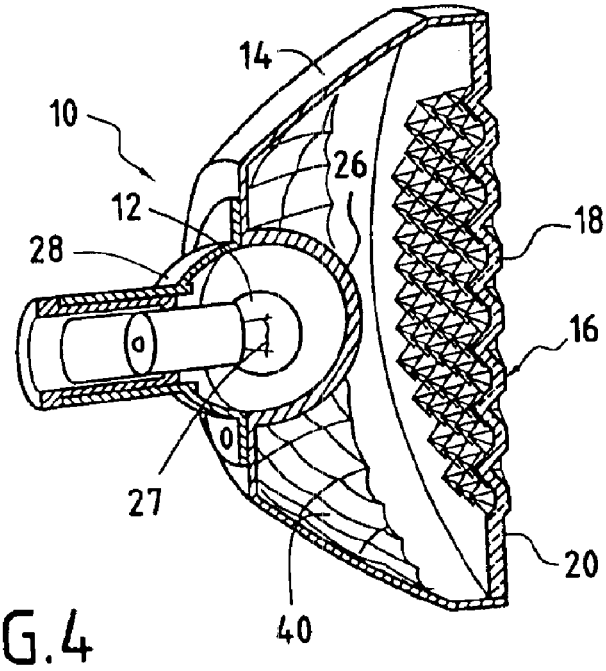

Two examples of embodiments of the lighting device according to the invention are explained below with reference to the schematic drawings attached, of which FIG. 1 shows a longitudinal section through a first example of an embodiment of the lighting device according to the invention, FIG. 2 shows a perspective view of the first example of an embodiment of the lighting device according to the invention represented in FIG. 1, FIG. 3 shows a perspective view of a second example of an embodiment of the lighting device according to the invention, and FIG. 4 shows a perspective view of the second example of an embodiment of the lighting device according to the invention represented in FIG. 3.

In the figures attached a lamp that can be used in a motor vehicle is generally denoted by 10. The lamp 10 comprises a bulb 12 serving as light source, a first reflector 14 and an end cover 16. The end cover 16 of circular design shape has a circular first section 18 arranged around a centre point M of the end cover 16, together with an annular second section 20 enclosing the first section 18. The first section 18 is designed as reflex reflector and reflects light incident upon outer surface 22 thereof remote from the bulb 12. It is only slightly transparent for the light which the bulb 12 shines on to its inner surface 24 facing the bulb 12. By contrast, the annular second section 20 of the end cover 16 has a high light transmission.

The bulb 12 arranged behind the circular first section 18 of the end cover extends partially into the first reflector 14 and on its front side facing the end cover 16 is enclosed by a first hemispherical optically active element 26. A filament 27 of the bulb 12 is arranged at a focal point B of the first reflector 14 coinciding with the centre point of the first hemispherical optically active element 26. As is shown in FIGS. 1 and 3, the light emitted by the bulb 12 first passes through the first optically active element 26 and then strikes the first reflector 14.

The first optically active element 26 is provided with an annular prism and cylindrical lens, not shown in the figure, and non-optical surfaces. The prism lens produces a deflection or a total reflection of the incident light rays, whilst the cylindrical lens causes a dispersion. Through the non-optical surfaces the light is directed straight on to the first reflector 14 without being deflected or reflected.

The first optically active element 26 produces a deflection of the light rays emitted by the bulb 12, so that they strike the first reflector 14 at an angle of incidence, the associated angle of reflection of which causes the rays from the first reflector 14 to be directed on to the second section 20 of the end cover 16.

A hemispherical second reflector 28 is arranged on the rear side of the bulb 12 remote from the end cover 16. The hemispherical second reflector 28 is arranged over an aperture 29 formed in the first reflector 14 and through which the bulb 12 extends into the first reflector 14. The second reflector 28 likewise has an aperture 30, through which the bulb 12 extends into the second reflector 14. A cylindrical continuation 32 of the second reflector 28 encloses a socket holder 34 of the bulb 12. Light rays that are not shone directly from the bulb 12 towards the first optically active element 26 are reflected by the second reflector 28, so that the reflected rays also pass through the first optically active element 26. The second reflector 28 has a ventilation opening 36, which prevents the lamp 10 overheating.

In the embodiment of the lamp 10 represented in FIGS. 1 and 2, the first reflector 14 is designed as parabolic reflector, whilst the second section of the end cover 16 is designed to disperse light. The light dispersion in the second section 20 of the end cover 16 is produced by a plurality of lenses 38. As shown in FIG. 1, the parabolic reflector causes the light rays deflected by the first optically active element 26 to be reflected essentially parallel to one another on to the second section 20 of the end cover 16. There they are dispersed by the lenses 38, thereby ensuring a uniform distribution of the light passing through the second section 20.

In the alternative embodiment of the lamp 10 represented in FIGS. 3 and 4 the first reflector 14 is provided with a plurality of second optically active elements 40. As is shown in FIG. 3, the second optically active elements 40 produce a dispersion of the light rays incident upon the first reflector 14. The dispersed light rays are then deflected on to the second section 20 of the end cover 16. A dispersion lens formed in the second section 20, as has already been described in connection with the example of an embodiment represented in FIGS. 1 and 2, is not necessary in this embodiment of the lamp 10, since the uniform distribution of the light emitted by the light source is already ensured by the dispersion effect of the second optically active elements 40.

What is claimed is:

1. A lighting device for motor vehicles having a light source, an end cover having at least a first section and a second section, a first reflector, which directs light emitted by the light source on to the end cover, and a first optically active element, which is arranged in the ray path between the light source and the first reflector, through which light emitted by the light source first passes, and which deflects the light rays emitted by the light source so that the deflected rays strike the first reflector at an angle of incidence, the associated angle of reflection of which causes the rays from the first reflector to be directed at least substantially on to the second section of the end cover.

2. A lighting device according to claim 1, wherein the first section of the end cover has a lower light transmission than the second section of the end cover.

3. A lighting device according to claim 2, wherein the first section of the end cover is arranged in a central area of the end cover and is enclosed by the second section of the end cover.

4. A lighting device according to claim 1, wherein the first section of the end cover is arranged in a central area of the end cover and is enclosed by the second section of the end cover.

5. A lighting device according to claim 4, wherein the first section of the end cover is of circular design shape and the second section of the end cover is of annular design shape.

6. A lighting device according to claim 1, wherein the first section of the end cover is designed as reflex reflector for light externally incident on the end cover and the light source is positioned behind the first section of the end cover designed as reflex reflector.

7. A lighting device according to claim 1, wherein the light source is a bulb, the filament of which is arranged at a focal point of the reflector.

8. A lighting device according to claim 1, wherein the first optically active element is hemispherical.

9. A lighting device according to claim 1, wherein a second reflector which reflects light that is not shone directly from the light source on to the first optically active element, is arranged adjacent to the first reflector.

10. A lighting device according to claim 9, wherein the second reflector is hemispherical and has a cylindrical continuation.

11. A lighting device according to claim 10, wherein the second reflector is provided with at least one ventilation opening.

12. A lighting device according to claim 9, wherein the second reflector is provided with at least one ventilation opening.

13. A lighting device according to claim 1, wherein the first reflector is a parabolic reflector.

14. Alighting device according to claim 13, wherein the second section of the end cover is of light-dispersing design.

15. A lighting device according to claim 14, wherein a plurality of lenses is provided in the second section of the end cover.

16. A lighting device according to claim 1, wherein the first reflector is provided with a plurality of second optically active elements which disperse the light rays incident on the first reflector so that they are directed as diffused radiation to the second section of the end cover.

* * * * *